United States Patent [19]

Stoner, III

[11] 4,172,160

[45] Oct. 23, 1979

[54] METHOD AND COMPOSITION FOR PRODUCING A PROTECTIVE COATING FOR A METAL SURFACE AND RESULTANT PRODUCT

[76] Inventor: Frank R. Stoner, III, 640 Pine Rd., Sewickley, Pa. 15143

[21] Appl. No.: 849,694

[22] Filed: Nov. 8, 1977

[51] Int. Cl.[2] ..... B05D 5/08

[52] U.S. Cl. ..... 427/178; 260/28 R; 427/210; 427/211; 427/283; 428/147; 428/484

[58] Field of Search ..... 427/154, 156, 385 A, 427/443, 257, 287, 178, 283, 210, 211; 260/28 R, 28 P; 428/484, 147, 152

[56] References Cited

U.S. PATENT DOCUMENTS

| | | | |
|---|---|---|---|
| 1,996,392 | 4/1935 | Torrence et al. | 428/457 |
| 2,404,431 | 7/1946 | Canter et al. | 260/28 X |
| 2,982,670 | 5/1961 | Jett | 427/257 X |
| 3,041,195 | 6/1962 | Saewert et al. | 428/152 |
| 3,154,427 | 10/1964 | Forrest et al. | 427/257 |
| 3,506,474 | 4/1970 | Neuhaus et al. | 428/147 |
| 3,639,316 | 2/1972 | Argiro | 260/28 X |
| 3,706,589 | 12/1972 | Fukuda et al. | 427/154 |
| 3,775,175 | 11/1973 | Merian | 427/118 X |

OTHER PUBLICATIONS

Grant, J. (editor), *Hackh's Chemical Dictionary*, 4th ed., 1972, p. 722.

*Primary Examiner*—Evan K. Lawrence

*Attorney, Agent, or Firm*—Webb, Burden, Robinson & Webb

[57] ABSTRACT

A texturized coating applied to one or both surfaces of bare or prepainted metal coil or sheet protects the surface against damage before, during, and after fabrication. The coating consists essentially of a thermosetting resin vehicle and a high molecular weight, hard, paraffin wax which, when cured, at a temperature greater than the melting point of said wax provides a reduced surface contact area of lubricating beads high in wax content.

15 Claims, 1 Drawing Figure

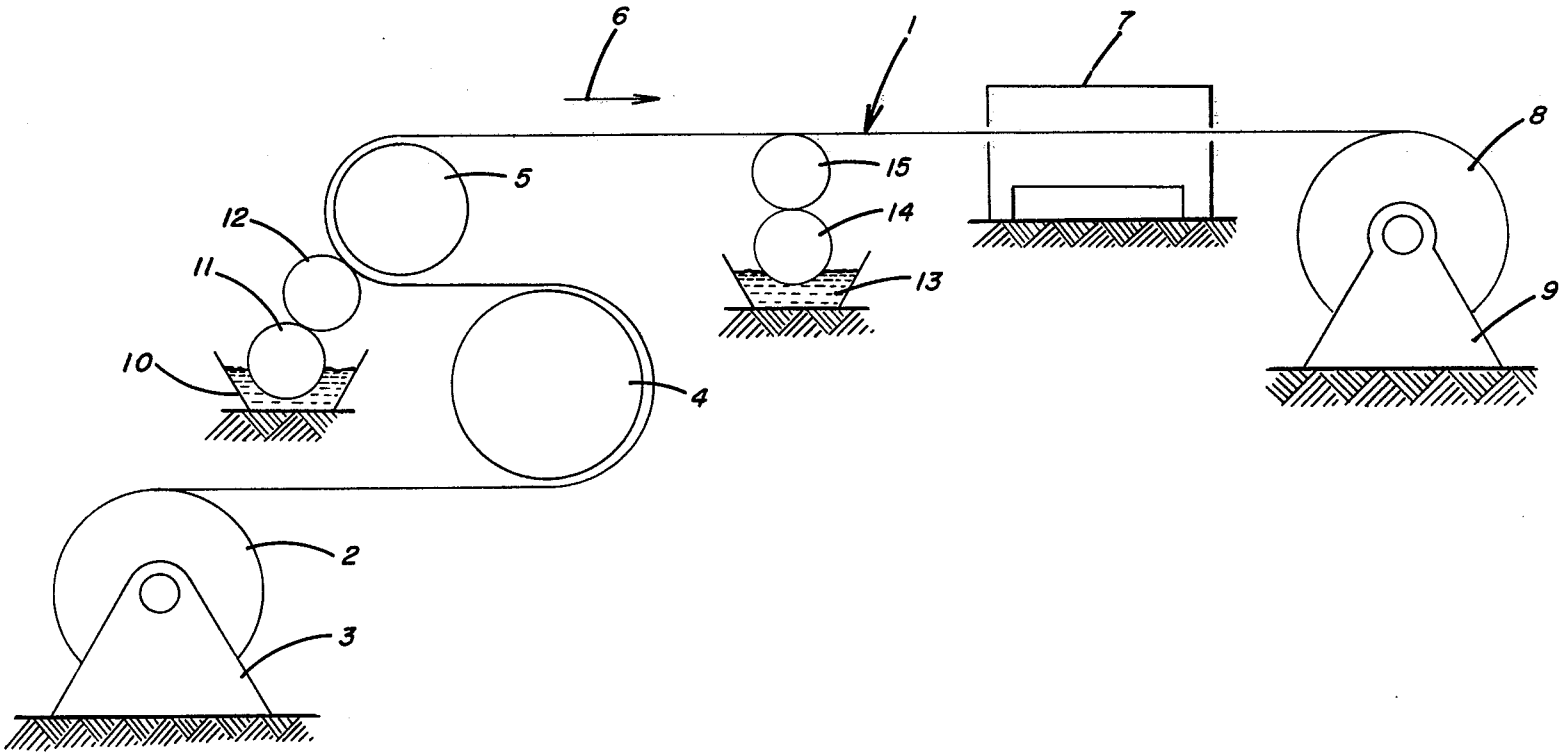
1
2
3
4
5
6
7
8
9
10
11
12
13
14
15

METHOD AND COMPOSITION FOR PRODUCING A PROTECTIVE COATING FOR A METAL SURFACE AND RESULTANT PRODUCT

BACKGROUND OF THE INVENTION

This invention relates to a texturized coating for protecting bare or coated metal and particularly to such a coating which will prevent damage to bare or prepainted metal surfaces of coil, or sheet, especially through marring, scratching, burnishing and cutting.

Galvanized steel, aluminum, cold rolled steel, and other metal substrates for use in the automotive, industrial and residential building, appliance, and other metal products fabricating industries are frequently finished using a continuous coil painting process. In such a process, the continuous coils of metal are uncoiled, cleaned, chemically treated, and coated with one or more coats of protective and/or decorative paint, baked to cure or dry the paint, then recoiled for future handling, shipment, and fabrication into the desired end product.

The painted top and bottom surfaces of the metal coil or sheet come into contact with each other either in the painted coil before fabrication, or when roll-formed or otherwise fabricated sheets or parts are stacked for subsequent handling or shipment. During handling and shipment of both painted coils and fabricated parts, the painted surfaces often rub against each other due, for example, to vibration, slippage in the coil, shifting in a stack of sheets or similar causes. When this occurs, one or both painted surfaces may become marred or burnished, and in some cases, the surfaces are severely scratched or even cut through to bare metal. This surface damage results in an unsightly end product, frequently requires a costly touch-up painting operation, or in the worst cases, the coated metal must be rejected and scrapped.

Surface damage, such as burnishing, marring, or scratching can occur during recoiling of the painted coil, during slitting to desired width, during stacking of parts after fabrication of the painted coil, and during movement of stacked fabricated sheets or parts from one location to another. One common solution to this problem has been to interleaf the coil and/or the stacked parts with paper or plastic sheet. This, however, is costly, and results in an additional problem of disposing of the used interleafing material. In addition, the interleafing material may stick to the painted surfaces during storage, absorb water or chemical substances that may stain the painted surfaces, and in some cases the interleafing material may actually emboss the painted surfaces if there are any folds or other imperfections in the interleafing material.

The invention described herein provides a new and unobvious solution to the problem and reduces or eliminates the possibility of damage to bare or prepainted metal surfaces. Although texturized coatings, for example including "Acrawax", have previously been used to disguise or cover marrings on metal surfaces or for aesthetic purposes, they were neither intended nor designed to eliminate marring.

SUMMARY OF THE INVENTION

This invention involves a self-texturizing coating composition, the method of applying the coating to a metal surface and coated metal formed by the method. The coating may be applied to one or both sides of metal coil or sheet. The coating may be applied over bare metal or over a suitable primer or color coat. Upon application, usually by roller coat, the coating tends to de-wet the metal substrate, forming a dense pattern of small eyeholes in the wet film. When the coating is dried or cured in the baking oven preferably heated to a temperature in excess of 300° F. and more preferably at a temperature of about 400°–450° F., it is set into a highly textured pattern, preferably with a minimum film thickness of near zero and a maximum film thickness of between 0.0003" and 0.001". The essential constituents of this textured film are a thermosetting resin vehicle, such as amine cured polyester, amine cured acrylic, or phenolic cured epoxy, and a high molecular weight, hard, paraffin wax. Surface active agents may be incorporated to provide the de-wetting of the wet film and subsequent texturizing of the dry film.

The contact area between texturized coated painted surfaces of metal coil or sheets is reduced substantially relative to the actual area of contacting surface. This tends to reduce the coefficient of friction between the surfaces. Also, the beads of the texturized coating are high in wax content, and this tends to lubricate the reduced contact area. Consequently, when one painted surface moves with respect to another painted surface with which it is in contact, the chance of film tearing, marring, or abrasion is reduced substantially. This will minimize or eliminate painted metal scrap as heretofore described.

The invention is applicable to many products; some typical products that might utilize this invention are as follows: prepainted industrial or commercial siding or roofing sheet; prepainted siding and accessory parts for mobile homes and recreational vehicles; interior building products, such as accoustical ceiling suspension systems, baseboard heating units, and door or window frames; prepainted metal sign blanks; prepainted metal for office equipment, such as desks and file cabinets; and prepainted metal for awnings, canopies, car ports, and other similar building products.

BRIEF DESCRIPTION OF THE DRAWING

In the single FIGURE of the application is shown a conventional roller coating line suitable for application of the texturized coating to one or both surfaces of metal sheet or coil in accordance with the present invention.

DESCRIPTION OF A PREFERRED EMBODIMENT OF THE INVENTION

In a conventional roller coating line, as shown in the drawing, a continuous metal sheet 1 is pulled, at a constant speed, from a coil 2, on a stationary capstan 3 over rollers 4 and 5 in the direction shown by arrow 6 and through an oven 7. The metal 1 is wound in a coil 8 on a stationary capstan 9 located downstream of the oven.

During its travel, the sheet 1 passes one or more coating stations. A typical coating station comprises a container 10, a dipping roller 11 and a painting roller 12 which is in contact with a surface of the metal sheet. Coating may be applied to the opposite surface of the metal sheet 1 at a second station comprising container 13, dipping roller 14 and coating roller 15. Either or both of the coating stations may be used. After coating is applied to the travelling metal sheet, the sheet 1 passes through oven 7 where the coating is baked, typically at a metal temperature between 400° and 450° F., to cure the coating.

In subsequent operations, the coil 8 may be uncoiled, slit, sheared into lengths, and/or formed. It is in all of these operations that the problem of marring, scratching, burnishing, and/or cutting of the paint finish and/or metal may occur, and it is to eliminate such problems that the texturized coating in accordance with the present invention is useful.

Within my contemplation, moreover, is application of the texturized coating, for example, by gravure, spray finishing, or the like. It is necessary that proper controls be exercised over film thickness to achieve the benefits of the invention.

I have found that roller coating the texturizing solution according to the present invention to a thickness between 0.3 of a mil and 1 mil is satisfactory since the solution de-wets and pulls upwardly from the metal into little beads. The thinner the coating is applied, the smaller the beads are and the closer together they are, providing an effective texturized coating in which a substantial amount of wax is contained in the beads, resulting in a lubricating and protective surface.

Preferred texturized coatings, according to the invention, include solutions of polyester resins, epoxy resins, acrylic resins, and alkyd resins. The solutions may be made clear or they may include pigments, such as titanium dioxide or carbon black, or dyes. Colors may be selected from appropriate standard pigment tables.

EXAMPLE

A satisfactory texturized coating formulation in accordance with the invention comprises:

| | Parts |
|---|---|
| Saturated polyester resin | 581.00 |
| Melamine resin | 35.00 |
| N-Butanoal | 17.00 |
| Wax dispersion | 24.50 |
| Solvesso 150 | 106.00 |
| Isophorone | 38.50 |
| Butyl cellosolve | 38.50 |
| Curing Agent C solution | .50 |

The saturated polyester resin product may be obtained from commercial suppliers. The melamine resin is based on hexahydroxymethylo melamine. The curing agent C solution is preferably a blocked paratoluene sulfonic acid catalyst.

The paraffin wax suitable for use in the formulation is characterized by a relatively high melting point, for example of about 280°–300° F. One such wax is N,N'-ethylene bis stearamide which has a melting point of about 288°–291° F. It is substantially water insoluble except in powdered form at or above 176° F., insoluble in most solvents at room temperature, soluble in hot chlorinated and aromatic solvents. Most important, this wax precipitates or gels out of solution when cooled.

The texturized coating may be applied directly to bare metal; it can be applied to one or both surfaces of sheet or coiled metal; it can be applied to painted metal surfaces; or any combination thereof.

Texturized coatings in accordance with my invention provide additional advantages such as resistance to mildew, retention of gloss on exposure for long periods of time and resistance to adhesion of dirt. Moreover, the finished metal having a texturized coating has the appearance of being laminated and, consequently, appears to be richer, thicker, and aesthetically more attractive than unfinished or prepainted metal.

Having described presently preferred embodiments of the invention, it is to be understood that it may otherwise be embodied within the scope of the appended claims.

I claim:

1. A method of protecting the surface of metal sheet or coil against damage from marring, scratching, burnishing or the like comprising applying to said surface a film of a solution of a thermosetting resin vehicle and a high molecular weight, hard, paraffin wax and curing said solution at a temperature greater than the melting point of said wax, said solution being applied in a thickness sufficient to provide a reduced surface contact area of lubricating beads high in wax content on said surface after said curing.

2. A method as set forth in claim 1 wherein the wax comprises N,N'-ethylene bis stearamide.

3. A method as set forth in claim 1 in which the thermosetting resin vehicle is a saturated polyester resin.

4. A method as set forth in claim 1 wherein said temperature is about 400° to 450° F.

5. A method as set forth in claim 1 in which said hard, paraffin wax has a melting point of between about 280° and 300° F.

6. The method as set forth in claim 1 wherein the solution is applied by roller solution.

7. A method as set forth in claim 1 wherein the film thickness of the cured coating is less than 1 mil.

8. A method as set forth in claim 1 and including a surface active agent in the solution.

9. A method of protecting one or both surfaces of a coiled metal comprising feeding said metal continuously over rolls, rolling a solution of a coating composition onto said surface to be protected, said coating composition consisting essentially of a thermosetting resin vehicle and a high molecular weight, hard, paraffin wax, curing said coating composition by passing said metal through an oven heated to a temperature in excess of 300° F., said temperature being greater than the melting point of said wax to produce a reduced surface contact area of lubricating beads high in wax content on said surface and coiling said coated metal.

10. The method according to claim 9 wherein the wax comprises N,N'-ethylene bis stearamide.

11. The method according to claim 9 and including the step of protecting both surfaces.

12. A method as set forth in claim 9 wherein the film thickness of the cured coating is less than 1 mil.

13. A coating composition suitable for application to one or both surfaces of metal sheet or coil for protecting the surface against damage during and after fabrication consisting essentially of a solution of a thermosetting resin and a high molecular weight, hard, paraffin wax, which, when cured at a temperature greater than the melting point of the wax, provides a reduced surface contact area of lubricating beads high in wax content.

14. A texturized coating composition as set forth in claim 13 wherein the wax comprises N,N'-ethylene bis stearamide.

15. A coated metal having at least one surface coated with a coating consisting essentially of a thermosetting resin vehicle and a high molecular weight, hard, paraffin wax which is characterized by a reduced surface contact area of lubricating beads high in wax content.

* * * * *

UNITED STATES PATENT AND TRADEMARK OFFICE

CERTIFICATE OF CORRECTION

PATENT NO. : 4,172,160

DATED : October 23, 1979

INVENTOR(S) : Frank R. Stoner, III

It is certified that error appears in the above-identified patent and that said Letters Patent are hereby corrected as shown below:

Claim 6 - Column 4 Line 28

"solution" (second occurrence) should read --coating--

Signed and Sealed this

*Eighteenth* Day of *March 1980*

[SEAL]

*Attest:*

SIDNEY A. DIAMOND

*Attesting Officer*

*Commissioner of Patents and Trademarks*